US005281250A

United States Patent [19]

Hamamura et al.

[11] Patent Number: 5,281,250

[45] Date of Patent: Jan. 25, 1994

[54] POWDER MATERIAL FOR RARE EARTH-IRON-BORON BASED PERMANENT MAGNETS

[75] Inventors: Atsushi Hamamura, Kyoto; Katsumi Okayama, Kusatsu; Yuji Kaneko, Uji; Yasuhiro Okajima; Kaname Takeya, both of Niihama; Shuji Okada, Kagawa, all of Japan

[73] Assignees: Sumitomo Special Metals Company Limited, Osaka; Sumitomo Metal Mining Company Limited, Tokyo, both of Japan

[21] Appl. No.: 838,092

[22] Filed: Feb. 20, 1992

[30] Foreign Application Priority Data

Jan. 29, 1992 [JP] Japan ..... 4-040137

[51] Int. Cl.[5] ..... B22F 1/00

[52] U.S. Cl. ..... 75/255; 148/302

[58] Field of Search ..... 148/302; 420/83, 121; 75/255, 254

[56] References Cited

U.S. PATENT DOCUMENTS 4,898,625 2/1990 Otsuka et al. ..... 148/101
4,968,347 11/1990 Ramesh et al. ..... 148/103
4,975,213 12/1990 Sakai et al. ..... 420/121
5,049,203 9/1991 Mukai et al. ..... 148/101

FOREIGN PATENT DOCUMENTS 61-81603 4/1986 Japan ..... 148/302
63-127504 5/1988 Japan ..... 148/103

*Primary Examiner*—John P. Sheehan
*Attorney, Agent, or Firm*—Watson, Cole, Grindle & Watson

[57] ABSTRACT

A powder for producing permanent magnets, comprising a blend of powders [A] and [B] or [C] wherein:

alloy powder [A] has an $R_2Fe_{14}B$ phase and contains, in atomic percent, from 11 to 13% of at least one rare element, R, inclusive of Y, from 4 to 12% of B, and the balance Fe; or optionally, said powder has an $R_2(Fe,Co)_{14}B$ phase, an $R_2(Fe,Ni)_{14}B$ phase or an $R_2(Fe,Co,Ni)_{14}B$ phase, containing at least one selected from the group consisting of 10% or less of Co and 3% or less of Ni as a partially substitute for Fe;

powder [B] is an intermetallic compound having an intermetallic compound phase of R with Fe or Co inclusive of an $R_3Co$ phase (provided that Co may be partially substituted for by Fe), containing, in atomic percent, from 13 to 45% of at least one rare element, R, inclusive of Y, and the balance Co (provided that Co may be partially substituted for by Fe), powder [C] is an intermetallic compound having an intermetallic compound phase of R with Fe or Co inclusive of an $R_3Co$ phase (provided that Co may be partially substituted for by Fe) and an $R_2Fe_{14}B$ phase, containing, in atomic percent, from 13 to 45% of at least one rare element, R, inclusive of Y, 12% or less of B and the Co (provided that Co may be partially substituted for by Fe).

18 Claims, No Drawings

POWDER MATERIAL FOR RARE EARTH-IRON-BORON BASED PERMANENT MAGNETS

BACKGROUND OF THE INVENTION 1. Field of the Invention

The present invention relates to a powder mixture which is particularly low in oxygen content and which is useful as a starting powder for manufacturing an R-Fe-B based magnet containing R (at least one of the rare earth elements inclusive of Y), Fe, and B as the major components. The starting powder of the present invention comprises the following powders [A] and [B] blended at a predetermined ratio to give a magnet having a desired composition:

[A] an alloy powder which gives the principal phase (sometimes simply referred to hereinafter as a powder based on principal phase) composed mainly of an $R_2Fe_{14}B$ hard magnetic phase and having been prepared by a direct reduction diffusion process; and

[B] an intermetallic compound powder comprising a phase of an intermetallic compound between R and Fe or Co inclusive of an $R_3Co$ phase (wherein Co may be partly or largely replaced by Fe), this intermetallic compound powder containing a higher amount of a rare earth element as compared with the principal phase powder.

In addition, the starting powder of the present invention can comprise the above-mentioned powder [A] and the under-mentioned powder [C] blended at a predetermined ratio to give a magnet having a desired composition:

[C] an intermetallic compound powder comprising a phase of an intermetallic compound between R, Fe or Co and B inclusive of an $R_3Co$ phase (wherein Co may be partly or largely replaced by Fe) and partly $R_2(Fe\ Co)_{14}$ B phase, this intermetallic compound powder containing a higher amount of a rare earth element as compared with the principal phase powder.

An R-Re-B based permanent magnet, which is described in JP-A-59-46008 (the term "JP-A-" as used herein signifies a "unexamined published Japanese patent application"), is a representative of high performance permanent magnets known at present. An R-Fe-B permanent magnet exhibits excellent magnetic properties owing to a texture comprising a principal (hard magnetic) phase of a tetragonal ternary compound and an R-rich phase; it yields a coercive force, iHc, of 25 kOe or higher and an energy product, (BH)max, of 45 MGOe or higher, which are both considerably higher as compared with those of a conventional high performance rare earth-cobalt (REC) magnet. There has also been proposed various types of R-Fe-B magnets which are varied in composition to meet the diversified demands regarding magnetic properties.

To produce a variety of R-Fe-B permanent magnets by powder metallurgy, i.e., by sintering a powder, an alloy powder having a predetermined composition for the magnets should be prepared at first. Such alloy powders are produced at present by an ingot-making process and crushing (as described in JP-A-60-63304 and JP-A-60-119701) which comprises melting a rare earth material having been subjected to electrolytic reduction, casting the melt in a casting mould to obtain an alloy ingot having the desired composition for the magnet, and crushing the ingot to give an alloy powder at a predetermined granularity. Otherwise, a direct reduction and diffusion process as described in JP-A-59-219494 and JP-A-60-77943 is employed, which comprises preparing directly the alloy powder of the desired composition for the magnet, using a rare earth oxide, an Fe powder, and the like as the starting powder.

The ingot-making and crushing process provides an alloy powder relatively low in oxygen content. In this method, oxidation prevention can be easily conducted at the primary crushing process, however, primary Fe crystals tend to form 17 easily and the R-rich phase segregate to grow into large grains.

The direct reduction and diffusion process is advantageous in that the steps such as melting and coarse grinding (primary crushing) which are included in the ingot-making and crushing can be omitted. However, the final powder is often obtained with the $R_2Fe_{14}B$ principal phase being surrounded by the R-rich phase. Furthermore, since the R-rich phase is more finely and better dispersed than by the ingot-making and crushing process, the R-rich phase is susceptible to oxidation during the production process and therefore it contains a higher amount of oxygen. Accordingly, magnets of a certain composition suffer fluctuation in magnetic properties and the like, ascribed to the consumption of the rare earth elements.

The powder produced by a direct reduction and diffusion process is further advantageous in that the R-rich phase which surrounds the principal phase is relatively small. This signifies that the R-rich phase finely disperses as a liquid during the sintering, resulting in a dense magnet with a favorable squareness ratio.

As mentioned in the foregoing, an R-Fe-B based powder produced by a direct reduction and diffusion process for permanent magnets is advantageous in that it can be produced by a process in which steps of melting, coarse grinding, etc., can be omitted, and that it has a higher density with a favorable squareness ratio as a magnet. However, since the R-rich phase is finely and well dispersed in the powder thus produced, the powder becomes susceptible to oxidation and tends to contain a higher amount of oxygen as compared with a powder produced by an ingot-making and crushing process. This leads to a fluctuation in the magnetic characteristics of the final magnet due to a slight oxidation during the manufacturing process thereof.

It is possible to provide an intermetallic compound relatively stable against oxidation by adding elements such as Co and Ni to the R-rich phase and thereby reduce the oxygen content of the powder. However, it is not possible to optimally control the addition of such elements in such a manner to most effectively attain a predetermined composition.

That is, it is requisite that the amount of addition of one or plural rare earth elements is controlled to obtain magnetic properties as desired, and, if Co were to be added to reduce the oxygen content, the Co would diffuse not only into the R-rich phase as desired, but also into the principal phase to be included as a substituent for Fe.

Furthermore, though depending on the amount, the addition of elements such as Co and Ni reduces the coercive force of the magnet, and this is another point which makes it difficult to lower the oxygen content.

The starting powder for magnets prepared by both of the conventional processes, i.e., the ingot-making and crushing process and the direct reduction and diffusion process, is not a product obtained simply by effecting the process on a powder mixture having been blended to a desired composition depending on the required magnetic properties, but has a particular texture composed of a tetragonal ternary compound as the principal phase and an R-rich phase. Accordingly, the plural rare earth elements to be added should be controlled each to a predetermined content designed to obtain the desired alloy composition, so that it may yield the intended magnetic properties. Thus, the alloy composition and the compositional ratio should be always taken into consideration, for example, which rare earth element is more apt to be incorporated in the principal phase and which one is more likely to constitute the R-rich phase. This signifies that, to obtain magnetic properties as desired, the starting alloy powder should be prepared as such to give a specific composition being confined to an extremely narrow range.

In other words, it is very difficult to obtain a starting powder mixture having the metals and alloy powders blended exactly to the ratio of the desired magnet composition. To obtain a magnet having the characteristics as desired, there should be prepared a variety of alloy powders each differing in alloy structure and composition.

SUMMARY OF THE INVENTION

An object of the present invention is, in the light of the aforementioned circumstances with respect to the starting powder for R-Fe-B permanent magnets, to provide a starting powder for readily producing an R-Fe-B based permanent magnet, this starting powder comprising an alloy powder considerably reduced in oxygen content and thereby less apt to undergo oxidation during the manufacturing process of the magnet. Another object of the present invention is to provide a variety of starting powders for manufacturing R-Fe-B magnets each having magnetic properties as desired, by providing a starting powder which can be used, to a certain degree, as a general purpose powder by controlling the blending ratio.

To achieve the objects mentioned hereinbefore, i.e., to provide a starting powder for readily producing an R-Fe-B based permanent magnet, the starting powder comprising an alloy powder considerably reduced in oxygen content and thereby less apt to undergo oxidation during the manufacturing process of the magnet, the present inventors have conducted extensive studies on the powders produced by a direct reduction diffusion process, and, as a result, have found that the oxygen content of the alloy powder can be lowered by reducing the R-rich phase which is present as a phase surrounding the principal phase. It has now been found that an alloy powder having a predetermined magnet composition low in oxygen content and also capable of readily providing an alloy powder which can provide magnets having magnetic properties ranging in (BH)max from 20 to 45 can be obtained by a process comprising:

preparing by a direct reduction and diffusion process an alloy powder low in the R-rich phase and having a composition close to that of an $R_2Fe_{14}B$ phase;

preparing separately an intermetallic compound powder comprising an $R_2(Fe,Co)_{17}$ phase, and $R_2(FeCo)_{14}B$ phase, etc., inclusive of an $R_3Co$ phase (wherein Co may be partly or largely substituted by Fe), by adding Co to an R-rich alloy powder., and mixing the thus prepared powders.

The above-mentioned alloy powder can further be obtained by a process comprising., preparing by a direct reduction and diffusion process an alloy powder low in the R-rich phase and having a composition close to that of an $R_2Fe_{14}B$ phase; preparing separately an intermetallic compound powder comprising an $R_2(Fe\ Co)_{17}$ phase and $R_2(FeCo)_{14}B$ phase, etc., inclusive of an $R_3$ Co phase (wherein Co may be partly or largely substituted by Fe) by adding Co and B to an R-rich alloy powders; and mixing the thus prepared powder. The present invention has been completed based on these findings.

That is, the present invention provides a starting powder for producing an R-Fe-B based permanent magnet which comprises the powders [A] and [B] or [C] below being blended at a predetermined composition corresponding to an R-Fe-B based permanent magnet:

[A] an alloy powder produced by direct reduction diffusion process and having an $R_2Fe_{14}B$ phase as the principal phase and containing from 11 to 13% by atomic or R (wherein R represents at least one of rare earth elements inclusive of Y), from 4 to 12% by atomic of B, and balance Fe with unavoidable impurities; or optionally, the alloy powder being produced by direct reduction diffusion process and having an $R_2(Fe,Co)_{14}B$ phase, an $R_2(Fe,Ni)_{14}B$ phase or an $R_2(Fe,Co,Ni)_{14}B$ phase, as the principal phase, containing at least one selected from the group consisting of 10% by atomic or less of Co and 3% by atomic or less of Ni as a partial substituent for Fe;

[B] an intermetallic compound powder produced by direct reduction diffusion process and having an intermetallic compound phase of R with Fe or Co inclusive of an $R_3Co$ phase (provided that Co may be partially or largely substituted by Fe), containing from 13 to 45% by atomic of R (wherein R represents at least one of rare earth elements inclusive of Y) and balance Co (provided that Co may be partially or largely substituted by Fe) with unavoidable impurities; and

[C] an intermetallic compound powder produced by direct reduction diffusion process and having an intermetallic compound phase and $R_2Fe_{14}B$ phase or like of R with Fe or Co and B inclusive of an $R_3Co$ phase (provided that Co may be partially or largely substituted by Fe), and partly $R_2(FeCo)_{14}B$ phase, containing from 13 to 45% by atomic of R (wherein R represents at least one of rare earth element inclusive of Y), 12% by atomic or less of B and balance Co (provided that Co may be partially or largely substituted by Fe) with unavoidable impurities.

DETAILED DESCRIPTION OF THE INVENTION

The rare earth elements represented by R in the present invention is at least one selected from the heavy rare earth elements and the light rare earth elements inclusive of Y. Preferably, R is based on light rare earth elements such as Nd and Pr, or on a mixture with Nd, Pr, etc.

More specifically, Nd, Pr, La, Ce, Tb, Dy, Ho, Er, Eu, Sm, Gd, Pm, Tm, Yb, Lu, and Y can be used as R. R is not necessarily be a pure rare earth element, but applicable are also those industrially available and which have accompanying unavoidable impurities.

To obtain the alloy powder comprising the $R_2Fe_{14}B$ phase as the principal phase, the rare earth element represented by R should be incorporated at an amount of from 11 to 13% by atomic. If the content of R is less than 11% by atomic, iron remains as a residual iron containing no R and no B diffused therein. If the content of R exceeds 13% by atomic, an R-rich phase in excess is produced, which increases the oxygen content.

To obtain a favorable permanent magnet, the alloy powder should be controlled as such that the content of B is in the range of from 4 to 12% by atomic. If the amount of B is less than 4% by atomic, a high coercive force (iHc) can not be achieved; if the content of B should exceed 12% by atomic, only a low residual magnetic flux density (Br) results.

The alloy powder of the present invention contains, as a balance, Fe accompanied by unavoidable impurities. Preferably, Fe accounts for 75 to 85% by atomic of the alloy powder. If the amount of Fe is less than 75% by atomic, the composition becomes relatively rich in rare earth elements to increase the R-rich phase; if Fe is to be incorporated at an amount exceeding 85% by atomic, the composition this time becomes relatively deficient in rare earth elements to increase residual Fe, resulting in a non-uniform alloy powder.

The Co and Ni incorporated into the alloy powder to give the principal phase substitutes Fe in the $R_2Fe_{14}B$ principal phase to lower the coercive force. Thus, the content of Co and Ni should be controlled to 10% by atomic or less and 3% by atomic or less, respectively. In such a case in which Fe is partially substituted by Co or Ni, the content of Fe is from 62 to 85% by atomic.

The alloy powder prepared by a direct reduction diffusion process and comprising an $R_2Fe_{14}B$ principal phase preferably is completely free of the R-rich phase from the viewpoint of reducing the oxygen content. However, an R-rich phase content of 4% by weight to the total weight is allowable, since an R-rich phase present at such an amount does not have significant adverse effects in lowering the oxygen content.

The intermetallic compound powder which is produced by direct reduction diffusion process and having an intermetallic compound phase of R with Fe or Co and B inclusive of an $R_3Co$ phase (provided that Co may be partially or largely substituted by Fe), i.e., the R-rich alloy powder, comprises an $R_3Co$ phase or an $R_3Co$ phase whose Co is partially substituted by Fe. This powder comprises as the core portion thereof, one of the alloys selected from $RCo_5$, $R_2Co_7$, $RCo_3$, $RCo_2$, $R_2Co_3$, $R_2Co_{17}$, $RFe_2$, $Nd_2Co_{17}$, $Nd_2Co_{19}$, $Dy_6Fe_2$, DyFe, and the like and one of alloys selected from $R_2(FeCo)_{14}B$, $R_{1.11}(Fe\ Co)_4B_4$ and the like.

As mentioned, the composition of the R-rich alloy power is varied in the percentage of the rare earth element included in the intermetallic compound depending on the kind of the rare earth element and the amount thereof.

Preferably, the content of R is controlled to be in the range of from 13 to 45% by atomic. If the content of R is less than 13% by atomic, the liquid phase can not sufficiently develop at the sintering step in the manufacture of the magnet from a powder mixture comprising the R-rich phase being blended with the powder material for providing the principal phase. If the content of R exceeds 45% by atomic, the oxygen content becomes too high. Thus, an R content falling out of the defined range is not favourable. In the R-rich intermetallic compound powder, Co accounts for 1% by atomic or more, preferably, in the range of from 3 to 20% by atomic, and Fe may be incorporated as a substituent for the remainder. Further, if the content of B exceeds 12% by atomic, the B-rich phase or Fe-B phase other than the $R_2Fe_{14}B$ phase will be excessively presented. Thus, the B content falling out of the defined range is not favourable.

An alloy powder composed mostly of an $R_2Fe_{14}B$ phase is produced by selecting at least one of the raw (master) powders of metals and oxides, i.e., of the group consisting of ferroboron powder, iron powder, powder of rare earth metal oxides, and the like, in accordance with the desired composition to give the starting alloy powder for the magnet.

For instance, metallic Ca or $CaH_2$ is mixed with the powder of a rare earth metal oxide over at an amount 1.1 to 4.0 times by weight of the stoichiometrically required amount to reduce the rare earth metal oxide, and the resulting powder mixture is heated to a temperature range of from 900° to 1200° C. in an inert gas atmosphere to obtain a product which is immediately dropped into water thereafter to remove the reaction by-products. Thus can be obtained a powder composed of grains having an average granularity in the range of from 10 to 200 μm, which need not to be subjected to a further coarse grinding.

To obtain an R-rich alloy powder, a process similar to that for producing the alloy powder containing dominantly the $R_2Fe_{14}B$ phase as described above can be used. Accordingly, at least one of the raw powders of metals and oxides, i.e., of the group consisting of ferronickel powder, cobalt powder, iron powder, powder of rare earth metal oxides and ferroboron and the like, is selected in accordance with the kind and the amount of the rare earth elements which are incorporated in the desired composition.

The starting powder for producing an R-Fe-B based permanent magnet according to the present invention can be used, to a certain extent, as a general use powder, by controlling the blending ratio of the constituent powders in accordance with the magnetic properties as intended.

That is, the kind and the amount of the rare earth elements in the starting alloy powder are varied depending on the required magnetic properties to thereby produce starting alloy powders having a variety of compositions to use in the manufacture of R-Fe-B based magnets. More specifically, the process therefor comprises:

preparing an alloy powder by direct reduction diffusion process, said alloy powder having an $R_2Fe_{14}B$ phase as the principal phase with 4% or less of an R-rich phase, and containing from 11 to 13% by atomic of R (wherein R represents at least one of rare earth elements inclusive of Y), from 4 to 12% by atomic of B, and balance Fe with unavoidable impurities; or optionally, preparing by direct reduction diffusion process, a powder having an $R_2(Fe,Co)_{14}B$ phase or an $R_2(Fe,Ni)_{14}B$ phase or an $R_2(Fe,Co,Ni)_{14}B$ phase as the principal phase containing at least one of the group consisting of 10% by atomic or less of Co and 3% by atomic or less of Ni as a partial substituent for Fe;

preparing an intermetallic compound powder by direct reduction diffusion process, having an intermetallic compound phase of R with Fe or Co and B inclusive of an $R_3Co$ phase (provided that Co may be partially or largely substituted by Fe), containing from 13 to 45% by atomic of R (wherein R represents at least one of rare earth elements inclusive of Y)and 12% by atomic or less of B and balance Co (provided that Co may be partially or largely substituted by Fe) with unavoidable impurities; and blending the alloy powder comprising the principal phase with the powder of an intermetallic compound at a ratio of 60–97:40–3. Thus can be obtained a variety of alloy powders differed in composition, to meet the demand on diversifying magnetic properties.

The alloy powder is blended with the powder of an intermetallic compound at various ratios in the range of 60–97:40–3. If the alloy powder should account for 60% or less and the powder of an intermetallic compound should account for 40% or more, the constituent elements would take a long time to effect a homogeneous diffusion at the manufacturing of the magnet. On the other hand, if the content of the powder of the intermetallic compound were to be lowered to 3% or less and that of the alloy powder comprising the principal phase were to be 97% or more, the liquid phase at the sintering may not be sufficiently developed.

The present invention provides a favorable starting powder for producing an R-Fe-B based permanent magnet having an oxygen content as low as 2000 ppm or less.

If the powder is used as-produced, the alloy powder preferably is size-controlled so that the average granularity thereof fall in the range of from 1 to 80 μm, more preferably in the range of from 2 to 10 μm, if one expects to realize further improved magnetic properties. If the granularity of the alloy powder as-produced is too large, only a poor magnetic property, a low coercive force in particular, can be obtained. If the granularity of the alloy powder is so small as to be less than 1 μm, the powder suffers severe oxidation at the production of the permanent magnet, which comprises the steps of press molding, sintering, and annealing. In such a case again, no favorable magnetic properties can be expected.

To obtain a starting powder which enables an R-Fe-B based permanent magnet having a higher residual flux density and a higher coercive force, the blended powder preferably contains from 12 to 25% by atomic of a rare earth element represented by R, from 4 to 10% by atomic of B, from 0.1 to 10% by atomic of Co, and from 68 to 80% by atomic of Fe.

Furthermore, it is preferred that to the powder blend comprising an alloy powder having an $R_2Fe_{14}B$ phase as the principal phase and/or a powder of an intermetallic compound of R with Fe or Co and B inclusive of $R_3Co$ phase is added at least one of 3.5% by atomic or less of Cu, 2.5% by atomic or less of S, 4.5% by atomic or less of Ti, 15% by atomic or less of Si, 9.5% by atomic or less of V, 12.5% by atomic or less of Nb, 10.5% by atomic or less of Ta, 8.5% by atomic or less of Cr, 9.5% by atomic or less of Mo, 9.5% by atomic or less of W, 3.5% by atomic or less of Mn, 9.5% by atomic or less of Al, 2.5% by atomic or less of Sb, 7% by atomic or less of Ge, 3.5% by atomic or less of Sn, 5.5% by atomic or less of Zr, 5.5% by atomic or less of Hf, 8.5% by atomic or less of Ca, 8.5% by atomic or less of Mg, 7.0% by atomic or less of Sr, 7.0% by atomic or less of Ba, and 7.0% by atomic or less of Be, to thereby increase the coercive force, enhance corrosion resistance, and improve the temperature characteristics.

A favorable magnetically anisotropic permanent magnet can be obtained from the alloy composition of the present invention. Particularly, magnetically anisotropic permanent magnet containing from 11 to 25% by atomic of R, from 4 to 10% by atomic B, from 30% by atomic or less of Co, and from 66 to 82% by atomic of Fe yield excellent characteristics such as a coercive force, iHc, of 5 kOe or higher and an energy product, (BH)max, of 20 MGOe or higher. Furthermore, the temperature coefficient of the remanence of the magnet in this case becomes as low as 0.1%/°C. or less.

Most favorable magnetic properties can be achieved with a permanent magnet composition in which a light rare earth metal account for 50% or more of the major component represented by R, and which contain from 12 to 20% by atomic of R, from 4 to 10% by atomic of B, from 66 to 82% by atomic of Fe, and 20% by atomic or less of Co. In particular, a (BH)max attains a maximum as high as 40 MGOe or higher when Nd, Pr, or Dy is included in the composition as a light rare earth element.

The present invention is described in further detail referring to EXAMPLES hereinafter. It should be understood, however, that the present invention is not to be construed as being limited thereto.

EXAMPLE 1

An alloy powder which provide the principal phase, i.e., the alloy powder based on the principal phase, was prepared by a direct reduction and diffusion process which comprises mixing 361 g of a 99% pure $Nd_2O_3$, 78.6 g of an Fe-B powder containing 19.1% of B, and 649 g of a 99% pure Fe metal powder with 193 g of a 99% pure metallic Ca and 36.1 g of anhydrous $CaCl_2$, and after charging the mixture into a stainless steel vessel, the powder mixture thus prepared was heated to 1000° C. and maintained at the temperature for 3 hours in flowing Ar gas to effect reduction with Ca and diffusion.

The resulting product thus obtained as a mixture by cooling was washed with water to remove excess Ca therefrom, and after effecting a water displacement treatment using alcohol and the like to the resulting powder slurry, the slurry was heated to dry in vacuum to obtain about 1000 g of a raw alloy powder.

This raw alloy powder was composed of grains about 18 μm in average diameter, and contained 12.0% by atomic of Nd, 0.2% by atomic of Pr, 7.7% by atomic of B, and balance Fe with an oxygen content of 1500 ppm. It was confirmed by observation on EPMA and the like that an $Nd_2Fe_{14}B$ phase was dominant in the powder.

An R-rich powder which provide the intermetallic compound was prepared in the same process as that employed for preparing the alloy powder above, by mixing 145.8 g of a 99% pure $Nd_2O_3$, 40.2 g of a 99.9% pure $Dy_2O_3$ powder, 19.3 g of a 99.9% pure Co metal powder, and 133.8 g of a 99% pure Fe metal powder with 97.5 g of a 99% pure metallic Ca and 18.6 g of anhydrous $CaCl_2$. Thus was obtained about 300 g of the raw powder.

This raw powder was composed of grains about 20 μm in average diameter, and contained 19.9% by atomic of Nd, 0.5% by atomic of Pr, 5.6% by atomic of Dy, 8.0% by atomic of Co, and balance Fe. It was confirmed by observation on EPMA and the like that the product was composed of an $R_3Co$ phase (containing Fe as a partial substituent for Co) and an intermetallic compound of a rare earth element with Fe and Co. The oxygen content thereof was 1100 ppm.

The two raw powders as obtained were blended as such that the alloy powder and the R-rich intermetallic compound powder may account for 80% and 20%, respectively, to give a starting powder material containing 13.3% by atomic of Nd, 0.3% by atomic of Pr, 0.9% by atomic of Dy, 6.5% by atomic of B, 1.3% by atomic of Co, and balance Fe. Thus was obtained a blended powder as a starting powder for a magnet.

The resulting starting powder was finely pulverized using a jet mill or the like to obtain a powder composed of grains about 3 μm in diameter, and after applying thereto magnetic alignment in a magnetic field of about 10 kOe, the powder was die-pressed under a perpendicular magnetic field by applying a pressure of about 2 ton/cm$^2$ to obtain a magnet molding having a dimension of 15 mm×20 mm×8 mm. The as-produced molding was sintered in Ar atmosphere at 1100° C. for 2 hours, and was subjected thereafter to annealing at 500° C. for a duration of 2 hours.

Thus was obtained a magnet specimen containing 4600 ppm of oxygen and having magnetic properties of Br of 12.2 kG, (BH)max of 36.2 MGOe, and iHc of 17.56 kOe.

Additionally, a powder mixture was prepared as such that the alloy powder for the principal phase and the R-rich powder for the intermetallic compound account for 85% and 15%, respectively. This blended powder contained 12.7% by atomic of Nd, 0.2% atomic of Pr, 0.5% by atomic of Dy, 7.1% by atomic of B, 0.9% by atomic of Co, and balance Fe. A magnet was produced from this blended powder in the same procedure as that employed above.

Thus was obtained a magnet specimen containing 4800 ppm of oxygen and having magnetic properties of Br of 12.9 kG, (BH)max of 39.7 MGOe, and iHc of 15.28 kOe.

COMPARATIVE EXAMPLE 1

A starting powder for producing a magnet was prepared by a direct reduction diffusion process which comprises mixing 386 g of a 99% pure $Nd_2O_3$, 26.8 g of a 99.9% pure $Dy_2O_3$, 62.9 g of an Fe-B powder containing 19.1% of B, 12.9 g of a 99.9% pure Co metal powder, and 608.4 g of a 99% pure Fe metal powder with 219.5 g of a 99% pure metallic Ca and 41 g of anhydrous $CaCl_2$, and after charging the mixture into a stainless steel vessel, the powder mixture thus obtained was heated to 1000° C. and maintained at the temperature for 3 hours in flowing Ar gas to effect reduction with Ca and diffusion.

The resulting product thus obtained as a mixture by cooling was washed with water to remove excess Ca therefrom, and after effecting a water displacement treatment using alcohol and the like to the resulting powder slurry, the slurry was heated to dry in vacuum to obtain about 1000 g of a raw starting powder.

The powder thus obtained had a composition equivalent to that of the powder mixture of EXAMPLE 1 composed of 80% of the alloy powder for the principal phase and 20% of the R-rich powder for the intermetallic compound, i.e., 13.3% by atomic of Nd, 0.3% by atomic of Pr, 0.9% by atomic of Dy, 6.5% by atomic of B, 1.3% by atomic of Co, and balance Fe. The powder was composed of particles having an average granularity of about 20 μm, and the oxygen content thereof was 2600 ppm.

Observations by EPMA and the like revealed that the principal $R_2Fe_{14}B$ phase contains occasionally Co as a partial substituent, and that the R-rich phase comprises an $Nd_3Co$ phase and an Nd-rich phase containing approximately 95% of Nd.

A magnet was obtained from the thus prepared powder in the same manner as that used for manufacturing the magnet of EXAMPLE 1, which yielded magnetic properties of Br of 12.0 kG, (BH)max of 35.1 MGOe, and iHc of 15.8 kOe. It can be seen that the magnet obtained in the present process is inferior to that obtained in EXAMPLE 1 with respect to the magnetic properties, and, furthermore, the oxygen content of this comparative magnet was as high as 6200 ppm.

EXAMPLE 2

An alloy powder which provide the principal phase was prepared by a direct reduction and diffusion process which comprises mixing 127.8 g of a 98% pure $Nd_2O_3$, 4.3 g of a 99.9% pure $Dy_2O_3$, 23.8 g of an Fe-B powder containing 19.1% of B, 3.9 g of a 99.5% pure Co metal powder, and 258.9 g of a 99% pure Fe metal powder with 70.5 g of a 99% pure metallic Ca and 13.2 g of anhydrous $CaCl_2$, and after charging the mixture into a stainless steel vessel, the powder mixture thus prepared was heated to 1000° C. and maintained at the temperature for 3 hours in flowing Ar gas to effect reduction with Ca and diffusion.

The resulting product thus obtained as a mixture by cooling was washed with water to remove excess Ca therefrom, and after effecting a water displacement treatment using alcohol and the like to the resulting powder slurry, the slurry was heated to dry in vacuum to obtain a raw alloy powder.

The raw alloy powder thus obtained was composed of grains about 15 μm in average diameter, and contained 11.2% by atomic of Nd, 0.3% by atomic of Pr, 0.4% by atomic of Dy, 1.1% by atomic of Co, 6.7% by atomic of B, and balance Fe with an oxygen content of 1100 ppm. It was confirmed by observation on EPMA and the like that an $R_2(Fe,Co)_{14}B$ phase was dominant in the powder.

An R-rich powder which provide the intermetallic compound was prepared in the same process as that employed for preparing the alloy powder above, by mixing 114 g of a 98% pure $Nd_3O_3$, 11.8 g of a 99.9% pure Co metal powder, and 95.2 g of a 99% pure Fe metal powder with 61 g of a 99% pure metallic Ca and 11.4 g of anhydrous $CaCl_2$.

The raw powder thus obtained was composed of grains about 22 μm in average diameter, and contained 25.0% by atomic of Nd, 0.7% by atomic of Pr, 8.0% by atomic of Co, and balance Fe. It was confirmed by observation on EPMA and the like that the product was composed of an $Nd_3Co$ phase (containing Fe as a partial substituent for Co) and an $Nd_2Fe_{17}$ phase (containing Co as a partial substituent for Fe). The oxygen content thereof was 1100 ppm.

The two raw powders thus obtained were blended as such that the alloy powder and the R-rich powder may account for 80% and 20%, respectively, to give a starting powder material containing 13.5% by atomic of Nd, 0.4% by atomic of Pr, 0.3% by atomic of Dy, 5.6% by atomic of B, 2.2% by atomic of Co, and balance Fe. Thus was obtained a blended powder as a starting powder for a magnet.

The resulting starting powder sintered in the same procedure as that employed in EXAMPLE 1, to thereby obtain a magnet specimen containing 4100 ppm of oxygen and having magnetic properties of Br of 13.2 kG, (BH)max of 41.7 MGOe, and iHc of 13.44 kOe.

Additionally, the raw powder prepared above were blended as such to obtain a powder mixture comprising 85% of the alloy powder and 15% of the R-rich powder, to give a starting powder mixture containing 12.9% by atomic of Nd, 0.4% by atomic of Pr, 0.4% by atomic of Dy, 5.9% by atomic of B, 2.0% by atomic of Co, and balance Fe. From this starting powder was produced a magnet following the same procedure described above.

Thus was obtained a magnet specimen containing 4800 ppm of oxygen and having magnetic properties of Br of 13.5 kG, (BH)max of 43.5 MGOe, and iHc of 11,.51 kOe.

EXAMPLE 3

The same materials used in EXAMPLE 1 were used to prepare an alloy powder for the principal phase by a direct reduction and diffusion process. The alloy powder thus obtained was composed of grains about 15 μm in average and contained 11.3% by atomic of Nd, 0.3% by atomic of Pr, 0.4% by atomic of Dy, 1.1% by atomic of Co, 6.8% by atomic of B, and balance Fe with an oxygen content of 1000 ppm.

An R-rich powder which provide the intermetallic compound was prepared in the same process as that employed in EXAMPLE 1, by mixing 61.5 g of a 98% pure $Nd_2O_3$, 6.4 g of a 99.9% pure Co metal powder, 0.6 g of a 99.9% pure Cu metal powder, and 45.9 g of a 99.9% pure Fe metal powder with 32.9 g of a 99% pure metallic Ca and 6.2 g of anhydrous $CaCl_2$.

This raw powder was composed of grains about 20 μm in average diameter, and contained 26.1% by atomic of Nd, 0.6% by atomic of Pr, 7.8% by atomic of Co, 0.6% by atomic of Cu, and balance Fe. The oxygen content thereof was 1200 ppm.

The two raw powders as obtained were blended as such that the alloy powder and the R-rich intermetallic compound powder may account for 80% and 20%, respectively, to give a starting powder material containing 13.8% by atomic of Nd, 0.3% by atomic of Pr, 0.3% by atomic of Dy, 2.2% by atomic of Co, 0.1% by atomic of Cu, 5.6% by atomic of B, and balance Fe. Thus was obtained a blended powder as a starting powder for a magnet.

The resulting starting powder was finely pulverized using a ball mill or the like to obtain a powder composed of grains about 3 μm in diameter, and the fine powder was prepared into a slurry. This fine slurry was charged into a metal mold, after applying thereto magnetic alignment in a magnetic field of about 10 kOe, the slurry was die-pressed under a perpendicular magnetic field by applying a pressure of about 1.5 ton/cm$^2$ to obtain a magnet molding having a dimension of 15 mm×20 mm×8 mm.

The residual solvent in the as-produced molding was removed in vacuum, and the molding thus obtained was sintered in Ar atmosphere at 1100° C. for 2 hours, followed by annealing at 500° C. for a duration of 2 hours.

Thus was obtained a magnet specimen containing 3500 ppm of oxygen and having magnetic properties of Br of 13.1 kG, (BH)max of 41.9 MGOe, and iHc of 15.65 kOe.

EXAMPLE 4

An alloy powder which provide the principal phase, i.e., the alloy powder based on the principal phase, was prepared by a direct reduction and diffusion process which comprises mixing 564 g of a 99% pure $Nd_2O_3$, 113.5 g of an Fe-B powder containing 19.1% of B, and 962.6 g of a 99% pure Fe metal powder with 301.7 g of a 99% pure metallic Ca and 56.4 g of anhydrous $CaCl_2$, and after charging the mixture into a stainless steel vessel, the powder mixture thus prepared was heated to 1000° C. and maintained at the temperature for 3 hours in flowing Ar gas to effect reduction with Ca and diffusion.

The resulting product thus obtained as a mixture by cooling was washed with water to remove excess Ca therefrom, and after effecting a water displacement treatment using alcohol and the like to the resulting powder slurry, the slurry was heated to dry in vacuum to obtain about 1458 g of a raw alloy powder.

This raw alloy powder was composed of grains about 16 μm in average diameter, and contained 12.5% by atomic of Nd, 0.3% by atomic of Pr, 7.0% by atomic of B, and balance Fe with an oxygen content of 1300 ppm. It was confirmed by observation on EPMA and the like that an $Nd_2Fe_{14}B$ phase was dominant in the powder.

An R-rich powder which provide the intermetallic compound was prepared in the same process as that employed for preparing the alloy powder above, by mixing 232.2 g of a 99% pure $Nd_2O_3$, 14.7 g of a 99.9% pure $Dy_2O_3$ powder, 66.1 g of a 99.9% pure Co metal powder, 34.9 g of an Fe-B powder containing 19.1% of B and 218.3 g of a 99% pure Fe metal powder with 131.29 g of a 99% pure metallic Ca and 24.7 g of anhydrous $CaCl_2$. Thus was obtained about 463.2 g of the raw powder.

This raw powder was composed of grains about 22 μm in average diameter, and contained 16.5% by atomic of Nd, 0.7% by atomic of Pr, 1.0% by atomic of Dy, 7.1% by atomic of B. 13.9% by atomic of Co, and balance Fe. It was confirmed by observation on EPMA and the like that the product was composed of an $R_3Co$ phase (containing Fe as a partial substituent for Co) and an intermetallic compound of a rare earth element with Fe and Co and an $R_2Fe_{14}B$ or like. The oxygen content thereof was 1200 ppm.

The two raw powders as obtained were blended as such that the alloy powder and the R-rich intermetallic compound powder may account for 70% and 30%, respectively, to give a starting powder material containing 13.6% by atomic of Nd, 0.3% by atomic of Pr, 0.2% by atomic of Dy, 6.7% by atomic of B, 4.0% by atomic of Co, and balance Fe. Thus was obtained a blended powder as a starting powder for a magnet.

The resulting starting powder was finely pulverized using a jet mill or the like to obtain a powder composed of grains about 3 μm in diameter, and after applying thereto magnetic alignment in a magnetic field of about 10 kOe, the powder was die-pressed under a perpendicular magnetic field by applying a pressure of about 2 ton/cm$^2$ to obtain a magnet molding having a dimension of 15 mm×20 mm×8 mm. The as-produced molding was sintered in Ar atmosphere at 1100° C. for 2 hours, and was subjected thereafter to annealing at 500° C. for a duration of 2 hours.

Thus was obtained a magnet specimen containing 3900 ppm of oxygen and having magnetic properties of Br of 13.2 kG, (BH)max of 41.8 MGOe, and iHc of 13.2 kOe.

COMPARATIVE EXAMPLE 2

A starting powder for producing a magnet was prepared by a direct reduction diffusion process which comprises mixing 382.6 g of a 99% pure $Nd_2O_3$, 5.7 g of a 99.9% pure $Dy_2O_3$, 60.2 g of an Fe-B powder containing 19.1% of B, 36 g of a 99.9% pure Co metal powder, and 570 g of a 99% pure Fe metal powder with 206.5 g of a 99% pure metallic Ca and 39 g of anhydrous $CaCl_2$, and after charging the mixture into a stainless steel vessel, the powder mixture thus obtained was heated to 1000° C. and maintained at the temperature for 3 hours in flowing Ar gas to effect reduction with Ca and diffusion.

The resulting product thus obtained as a mixture by cooling was washed with water to remove excess Ca therefrom, and after effecting a water displacement treatment using alcohol and the like to the resulting powder slurry, the slurry was heated to dry in vacuum to obtain about 1000 g of a raw starting powder.

The powder thus obtained had a composition equivalent to that of the powder mixture of EXAMPLE 1 composed of 70% of the alloy powder for the principal phase and 30% of the R-rich powder for the intermetallic compound, i.e., 13.6% by atomic of Nd, 0.9% by atomic of Pr, 0.7% by atomic of Dy, 1.2% by atomic of B, 3.5% by atomic of Co, and balance Fe. The powder was composed of particles having an average granularity of about 20 μm, and the oxygen content thereof was 2700 ppm.

Observations by EPMA and the like revealed that the principal $R_2Fe_{24}B$ phase contains occasionally Co as a partial substituent, and that the R-rich phase comprises an $Nd_3Co$ phase and an Nd-rich phase containing approximately 95% of Nd.

A magnet was obtained from the thus prepared powder in the same manner as that used for manufacturing the magnet of EXAMPLE 1, which yielded magnetic properties of Br of 12.3 kG, (HB)max of 36.5 MGOe, and iHc of 14.2 kOe. It can be seen that the magnet obtained in the present process is inferior to that obtained in EXAMPLE 1 with respect to the magnetic properties, and, furthermore, the oxygen content of this comparative magnet was as high as 6300 ppm.

As illustrated in the foregoing, the present invention comprises preparing an alloy powder having a composition near to the $R_2Fe_{14}B$ phase and low in R-rich phase by a direct reduction diffusion process, and adding Co and B metal to an R-rich powder to give an intermetallic compound-alloy powder which is composed of alloy particles comprising an intermetallic compound phase such as an $R_3Co$ phase, an $R_2(Fe,Co)_{17}$ phase and $R_2(FeCo)_{14}B$ phase having obtained by a partial substitution of Fe for Co and B in the $R_3Co$ phase, and the like. The powders are then mixed together to obtain an alloy powder low in oxygen, having a desired magnet composition which enables production of magnets improved in magnetic properties.

Furthermore, the present invention provides a variety of alloy powders comprising a plurality of compositions to produce therefrom R-Fe-B based permanent magnets, by varying the type and the amount of the rare earth elements incorporated therein in accordance with the various desired magnetic properties. For instance, an alloy powder corresponding to one of the desired compositions to give the principal phase is blended with various intermetallic compound powders having prepared by changing the amount of the intermetallic compound in the rare earth element. In such a manner it is possible to readily obtain a variety of alloy powders differing in composition according to the desired magnetic properties.

While the invention has been described in detail and with reference to specific embodiments thereof, it will be apparent to one skilled in the art that various changes and modifications can be made therein without departing from the spirit and scope thereof.

What is claimed is:

1. A starting powder for producing an R-Fe-B based permanent magnet, which comprises powders A and B blended at a weight ratio of 60–97 powder A to 40–3 powder B;

said powder A being an alloy powder produced by direct reduction diffusion and having an $R_2Fe_{14}B$ phase as the principal phase, containing from 11 to 13 atomic % of R, from 4 to 12 atomic % of B, and balance Fe with unavoidable impurities, and said powder B being an intermetallic compound powder produced by direct reduction diffusion process and having an intermetallic compound phase of R with Co or R with Fe and Co inclusive of an $R_3Co$ phase, provided that Co may be partially or largely substituted by Fe, containing from 13 to 45 atomic % of R, wherein R represents at least one of rare earth elements inclusive of Y, and balance Co, provided that Co may be partially or largely substituted by Fe, with unavoidable impurities.

2. The starting powder for producing an R-Fe-B based permanent magnet as claimed in claim 1, wherein the alloy powder based on the principal phase contains Fe in a range of from 75 to 85% atomic.

3. A starting powder for producing an R-Fe-B based permanent magnet, which comprises powders A and B blended at a weight ratio of 60–97 powder A to 40–3 powder B;

said powder A being an alloy powder produced by direct reduction diffusion process and having an $R_2(Fe,Co)_{14}B$ phase or an $R_2(Fe,Ni)_{14}B$ phase or an $R_2(Fe,Co,Ni)_{14}B$ phase as the principal phase, containing from 11 to 13 atomic % of R, wherein R represents at least one of rare earth elements inclusive of Y, from 4 to 12 atomic % of B, at least one selected from up to 10 atomic % of Co and up to 3 atomic % of Ni, and balance Fe with unavoidable impurities, and said powder B being an intermetallic compound powder produced by direct reduction diffusion process and having an intermetallic compound phase of R with Co or R with Fe and Co inclusive of an $R_3Co$ phase, provided that Co may be partially or largely substituted by Fe, containing from 13 to 45 atomic % of R, wherein R represents at least one of rare earth elements inclusive of Y and balance Co, provided that Co may be partially or largely substituted by Fe, with unavoidable impurities.

4. The starting powder for producing an R-Fe-B based permanent magnet as claimed in claim 3, wherein the alloy powder based on the principal phase contains Fe in a range of from 75 to 85% atomic.

5. A starting powder for producing an R-Fe-B based permanent magnet, which comprises powders A and B blended at a weight ratio of 60–97 powder A to 40–3 powder B;

said powder A being an alloy powder produced by direct reduction diffusion process and having an $R_2Fe_{14}B$ phase as the principal phase, containing from 11 to 13 atomic % of R, wherein R represents at least one of rare earth elements inclusive of Y, from 4 to 12 atomic % of B, and balance Fe with unavoidable impurities and said powder B being an intermetallic compound powder produced by direct reduction diffusion process and having an intermetallic compound phase of R with Co or R with Fe and Co inclusive of an $R_3Co$ phase, provided that Co may be partially or largely substituted by Fe, an $R_2Fe_{14}B$ phase, and containing from 13 to 45 atomic % of R, wherein R represents at least one of rare earth elements inclusive of Y, up to 12 atomic % of B, and balance Co, provided that Co may be partially or largely substituted by Fe, with unavoidable impurities.

6. The starting powder for producing an R-Fe-B based permanent magnet as claimed in claim 5, wherein the alloy powder based on the principal phase contains Fe in a range of from 75 to 85% atomic.

7. A starting powder for producing an R-Fe-B based permanent magnet, which comprises powders A and B blended at a weight ratio of 60–97 powder A to 40–3 powder B;

said powder A being an alloy powder produced by direct reduction diffusion process and having an $R_2(Fe,Co)_{14}B$ phase an $R_2(Fe,Ni)_{14}B$ phase or an $R_2(Fe,Co,Ni)_{14}B$ phase as the principal phase, containing from 11 to 13 atomic % of R, wherein R represents at least one of rare earth elements inclusive of Y, from 4 to 12 atomic % of B, at least one selected from up to 10 atomic % of Co and up to 3 atomic % of Ni, and balance Fe with unavoidable impurities, and said powder B being an intermetallic compound powder produced by direct reduction diffusion process and having an intermetallic compound phase of R with Co or R with Fe and Co inclusive of an $R_3Co$ phase, provided that Co may be partially or largely substituted by Fe, an $R_2Fe_{14}B$ phase, and containing from 13 to 45 atomic % of R, wherein R represents at least one of rare earth elements inclusive of Y, up to 12 atomic % of B, and balance Co, provided that Co may be partially or largely substituted by Fe, with unavoidable impurities.

8. The starting powder for producing an R-Fe-B based permanent magnet as claimed in claim 7, wherein the alloy powder based on the principal phase contains Fe in a range of from 62 to 85% atomic.

9. The starting powder for producing an R-Fe-B based permanent magnet as claimed in claims 1, 3, 5, or 7, wherein the alloy powder based on the principal phase contains an R-rich phase in an amount of up to 4% by weight.

10. The starting powder for producing an R-Fe-B based permanent magnet as claimed in claims 1, 3, 5, or 7, wherein the intermetallic compound powder contains Co in an amount of at least 1% atomic.

11. The starting powder for producing an R-Fe-B based permanent magnet as claimed in claim 10, wherein the intermetallic compound powder contains Co in an amount of from 3 to 20% atomic.

12. The starting powder for producing an R-Fe-B based permanent magnet as claimed in claims 1, 3, 5, or 7, wherein the oxygen content thereof is no more than 2000 ppm by weight.

13. The starting powder for producing an R-Fe-B based permanent magnet as claimed in claims 1, 3, 5, or 7, wherein said powder is composed of grains having an average granularity in a range of from 1 to 80 μm.

14. The starting powder for producing an R-Fe-B based permanent magnet as claimed in claim 13, wherein said powder is composed of grains having an average granularity in a range of from 2 to 10 μm.

15. The starting powder for producing an R-Fe-B based permanent magnet as claimed in claims 1, 3, 5, or 7, wherein said powder comprises from 12 to 25 atomic % of R, from 4 to 10 atomic % of B, from 0.1 to 10 atomic % of Co, and from 68 to 80 atomic % of Fe.

16. The starting powder for producing an R-Fe-B based permanent magnet as claimed in claims 1, 3, 5, or 7, wherein to the alloy powder based on the principal phase is added at least one of up to 3.5 atomic % of Cu, up to 2.5 atomic % of S, up to 4.5 atomic % of Ti, up to 15 atomic % of Si, up to 9.5 atomic % of V, up to 12.5 atomic % of Nb, up to 10.5 atomic % of Ta, up to 8.5 atomic % of Cr, up to 9.5 atomic % of Mo, up to 9.5 atomic % of W, up to 3.5 atomic % of Mn, up to 9.5 atomic % of Al, up to 2.5 atomic % of Sb, up to 7 atomic % of Ge, up to 3.5 atomic % of Sn, up to 5.5 atomic % of Zr, up to 5.5 atomic % of Hf, up to 8.5 atomic % of Ca, up to 8.5 atomic % of Mg, up to 7.0 atomic % of Sr, up to 7.0 atomic % of Ba, and up to 7.0 atomic % of Be.

17. The starting powder for producing an R-Fe-B based permanent magnet as claimed in claims 1, 3, 5, or 7, wherein to the intermetallic compound powder is added at least one of up to 3.5 atomic % of Cu, up to 2.5 atomic % of S, up to 4.5 atomic % of Ti, up to 15 atomic % of Si, up to 9.5 atomic % of V, up to 12.5 atomic % of Nb, up to 10.5 atomic % of Ta, up to 8.5 atomic % of Cr, up to 9.5 atomic % of Mo, up to 9.5 atomic % of W, up to 3.5 atomic % of Mn, up to 9.5 atomic % of Al, up to 2.5 atomic % of Sb, up to 7 atomic % of Ge, up to 3.5 atomic % of Sn, up to 5.5 atomic % of Zr, up to 5.5 atomic % of Hf, up to 8.5 atomic % of Ca, up to 8.5 atomic % of Mg, up to 7.0 atomic % of Sr, up to 7.0 atomic % of Ba, and up to 7.0 atomic % of Be.

18. The starting powder for producing an R-Fe-B based permanent magnet as claimed in claims 1, 3, 5, or 7, wherein to the alloy powder based on the principal phase and the intermetallic compound powder is added at least one of up to 3.5 atomic % of Cu, up to 2.5 atomic % of S, up to 4.5 atomic % of Ti, up to 15 atomic % of Si, up to 9.5 atomic % of V, up to 12.5 atomic % of Nb, up to 10.5 atomic % of Ta, up to 8.5 atomic % of Cr, up to 9.5 atomic % of Mo, up to 9.5 atomic % of W, up to 3.5 atomic % of Mn, up to 9.5 atomic % of Al, up to 2.5 atomic % of Sb, up to 7 atomic % of Ge, up to 3.5 atomic % of Sn, up to 5.5 atomic % of Zr, up to 5.5 atomic % of Hf, up to 8.5 atomic % of Ca, up to 8.5 atomic % of Mg, up to 7.0 atomic % of Sr, up to 7.0 atomic % of Ba, and up to 7.0 atomic % of Be.

* * * * *